US008857223B2

(12) United States Patent
Cao et al.

(10) Patent No.: US 8,857,223 B2
(45) Date of Patent: Oct. 14, 2014

(54) WASHING METHOD WHICH HAS NO NEED OF ADDING DETERGENT BY THE USER AND THE WASHING MACHINE THEREOF

(75) Inventors: Chunhua Cao, Shandong Province (CN); Peishi Lv, Shandong Province (CN); Ruixian Wang, Shandong Province (CN); Chongzheng Li, Shandong Province (CN); Chunfeng Zhang, Shandong Province (CN); Mei Li, Shandong Province (CN)

(73) Assignees: Haier Group Corporation (CN); Qingdao Haier Washing Machine Co., Ltd. (CN)

( * ) Notice: Subject to any disclaimer, the term of this patent is extended or adjusted under 35 U.S.C. 154(b) by 2252 days.

(21) Appl. No.: 10/566,767

(22) PCT Filed: Jul. 13, 2004

(86) PCT No.: PCT/CN2004/000797

§ 371 (c)(1),
(2), (4) Date: Nov. 15, 2006

(87) PCT Pub. No.: WO2005/010268

PCT Pub. Date: Feb. 3, 2005

(65) Prior Publication Data

US 2007/0180866 A1 Aug. 9, 2007

(30) Foreign Application Priority Data

Jul. 31, 2003 (CN) ..... 03 1 43942
Nov. 14, 2003 (CN) ..... 2003 2 0121901

(51) Int. Cl.

| | |
|---|---|
| ***D06F 29/00*** | (2006.01) |
| ***D06F 39/08*** | (2006.01) |
| ***D06F 35/00*** | (2006.01) |
| ***D06F 39/02*** | (2006.01) |

(52) U.S. Cl.
CPC ..... *D06F 39/088* (2013.01); *D06F 35/003* (2013.01); *D06F 39/022* (2013.01)
USPC ..... 68/17 R

(58) Field of Classification Search
USPC ..... 68/13 A, 17 R
See application file for complete search history.

(56) References Cited

U.S. PATENT DOCUMENTS 5,331,986 A * 7/1994 Lim et al. ..... 134/88
5,947,135 A * 9/1999 Sumida et al. ..... 134/95.3

FOREIGN PATENT DOCUMENTS

CN 1255880 6/2000

(Continued)

OTHER PUBLICATIONS

Machine Translation of Hasegawa. JP 10-033448, Oct. 1998.*

(Continued)

*Primary Examiner* — David Cormier
(74) *Attorney, Agent, or Firm* — James P. Muraff; Neal, Gerber & Eisenberg LLP

(57) ABSTRACT

A washing machine which has no need of adding detergent by the user and the washing method thereof the said washing method comprises balancing setting the PH surface tension electrical conductivity and hardness of the washing liquid in a certain range, washing in general automatic washing machine with the use of a high PH electrolyzed water combined with a regulator; in which the PH of the said washing liquid is in the range of 8.5-1 I, the electrical conductivity of it is in the range of 261 us/cm-875 us/cm the surface tension is in the range of 2540 mN/m, the hardness is in the range of 5-400 ppm, if necessary 0.20.3 g/time of the regulator could be added in the above condition according to, the method of the invention it is possible to, realize washing without detergent; because the washing liquid is subjected to the treatment, the cost of the detergent will be saved and the pollution caused by detergents will be avoided, at the same time, the fabric hardening due to, it will be overcome, and an optimum washing condition will be obtained.

10 Claims, 6 Drawing Sheets

(56) References Cited

FOREIGN PATENT DOCUMENTS

| | | | |
|---|---|---|---|
| CN | 99800057 | | 6/2000 |
| CN | 02106217 | | 11/2002 |
| GB | 2052251 | | 1/1981 |
| JP | 5084384 | | 4/1993 |
| JP | 10033448 A | * | 2/1998 |
| JP | 2000312798 | | 11/2000 |
| JP | 2003079998 | | 3/2003 |
| RU | 2032782 | | 4/1995 |

OTHER PUBLICATIONS

International Search Report dated Nov. 4, 2004 for PCT Application PCT/CN2004/000797.

* cited by examiner

WASHING METHOD WHICH HAS NO NEED OF ADDING DETERGENT BY THE USER AND THE WASHING MACHINE THEREOF

FIELD OF THE INVENTION

The present invention relates to a washing condition for washing machine. More specifically, this invention relates to a washing method and a washing machine, through which the efficient detergency ratio can been ensured even without adding any detergent.

DESCRIPTION OF THE PRIOR ART

Presently, users have to add a large quantity of washing powder into their washing machines when washing the laundry. Nevertheless, washing powder left on the laundry may irritate the skin of human body. More than that, the non-degradable detergent contained in discharging water will cause environmental pollution.

In recent years, washing machine that takes advantage of electrolyzed water for washing or sterilization and disinfection has come into being. In the circumstance of washing without detergent, users have to intensify the electrolytic efficiency to produce strong alkaline water with a relatively high PH so as to enhance washing efficiency. Unfortunately, the strongly alkaline water brings more intense causticity to laundry, though it seems to make them much cleaner.

References relate to washing process with the assistance of electrolytic ionized water, auxiliary modifying agent, or even use a drastically reduced amount of a detergent or without the use of a detergent are listed as below:

A washing machine equipped with a water ionizing device was disclosed in CN99248529, in which, an outlet pipe for positive ionized water and an outlet pipe for negative ionized water with valves is connected with each side of the water ionizing device respectively, and both the outlet pipes are linked to the washing tub to supply for lessening pollution and saving water.

CN00110127 disclosed an electrochemical washing machine and electrochemical detergent by which the water will be softened, greasy stains are emulsified and decomposed, color stains are bleached out, sterilization and disinfection is achieved, and re-adhesion of washed-off dirt on the laundry is prevented by electrophoresis and electrolysis. In addition, washing process under the softening or sizing procedure will be more time and money-saving. The specific electrochemical detergent is comparatively low in manufacturing cost, has less pollution to the environment for less dosage.

CN01139901 disclosed a water-purifying system for household use, and a washing machine thereof. The hardening components, organic substances and contaminants can be separated and removed from the washing water by this system.

CN02106217 disclosed an electric washing machine, in which the laundry is washed by electrolyzed water, in particular, air is supplied into the electrolyzing cell to generate water streams in order to improve the electrolytic efficiency during electrolysis, and the washing performance can be improved by electrolyzed water.

CN99800057 disclosed a washing process and washing device. Specifically, a washing process washes items to be washed simultaneously with softening washing water comprising alkali metal ion and at least one of carbonate ion and bicarbonate ion. The washing water before being softened is obtained by electrolyzing an aqueous solution of sodium hydrogencarbonate having a pH of 9.5 or more and an electric conductivity of 150 mS/m or more. The softened washing water has a total hardness of 40 ppm or less. However, in this process or device, an electrolyte is required to be added, and the influence of hardness described in it is not an essential item for the inventors' experiments of this invention.

CN96243576.7 disclosed an electrolytic device, comprising a housing, a filter, electrolyzing cell, AC/DC power supply converter, control buttons, "prompt" switch, wastewater tank, control circuit etc. This electrolytic device is a dual-purpose consecutive electrolyzing water supplying device, which can either connect with tap water tube directly, or can be used with its water storage tank in the absence of tap water tube.

CN99211396.2 disclosed a washing machine capable of killing off viruses and germs on the clothes and other washing items. A DC electrolytic device and a DC regulated power supply inside the housing of current washing machine. The DC Voltage-stabilized source is linked to the power of the washing machine, so that the DC Voltage-stabilized source provides direct current to support the DC electrolytic device as washing machine is working. Water flowing into the DC electrolytic device through inlet tube of washing machine, chlorine ion contained in water is electrolyzed, and hypochlorous acid (HClO) is produced in the water, afterwards kills the viruses and germs on the laundry in washing machine. This device not only achieves an excellent washing result, but also enjoys a low cost attributed to its simple structure. Regarding the electrolytic device performing electrolysis on the water-supply path, a power supply board with large power should be taken to ensure the electrolytic efficiency, but it may lead to heat of the board.

Electrolyzed water is sometimes applied for washing, sterilizing and disinfecting purpose in recent years. One way is to install electrolytic device onto the inside wall of the outer tub, as disclosed in the electric washing machine of CN02106218.8 in which electrolytic device is placed onto the inside wall of the outer tub, but its disadvantage is: the outer tub will sway and vibrate along with the rotating of water streams in the washing course, and as a result, the electrolytic device projecting forward is likely to be damaged.

It is known from the above prior art that the electrolyzed water generating devices are all arranged on the outer tub of washing machine's housing. Nevertheless, noticing the emergence of customers' new consuming conception nowadays, namely, pursuing lighter, thinner, smaller, and multi-functional products, the inventor of this invention have realized that if the electrolyzed water generating means are put between outer tub and housing, the applicable space left for washing machine shall be smaller; still worse, it will also place the wiring design under a condition of embarrassment. So, to develop a new washing machine that can make full use of the applicable place, and to satisfy all the requirements mentioned above, is the main problem that the inventors of this invention seek to solve urgently.

Furthermore, it is unrealistic to add electrolyzed water generating means and modifying agent-feeding device on the double driven washing machine of the prior art. The reason is that in order to achieve the goal, designers need to re-disassemble the washing machine, re-design the wiring, and arrange electrolytic device and modifying agent feeding device inside the washing machine, which undoubtedly, will take too much time, consume too much recourses, bring about too much manufacturing costs and other defects, so it may be impossible to retrofit the existing washing machines. Hence, when seeking to solve the first technical problem, the inventors of this invention take into account of the second technological problem to provide a simple and convenient washing machine without addition of a detergent by the users during washing process.

Making use of electrolysis method according to the prior art to wash clothes usually has the following disadvantages, particularly when it is asserted washing without the use of a detergent: (1) Electrolyte, e.g. sodium chloride and other activators, is put into washing water to enhance the electrolytic efficiency. Though the electrolytic efficiency is improved by adding the electrolyte, the subsequent change in water quality will probably result in fabric hardening; moreover, electrolyte has to be added by the user of washing machine manually, otherwise, the washing effects shall be barely satisfactory. (2) Bubbles are introduced into washing water to upgrade the detergency ratio. Apparently, it will make the mechanism more complex and increase the cost; (3) Some references suggest two times washing operation (re-washing process), but as a matter of fact, it implies that washing time shall be prolonged.

Furthermore, according to the references disclosed in the prior art, no definite direction, objective and process of research should be followed on to obtain the best washing effects and conditions for washing machines. Thus, the inventor of this invention study the washing conditions and device to solve the technical defects and disadvantages discussed above, and finally succeeded in finding out the way to attain the best washing effects on the appropriate washing conditions, thanks to their persistent efforts of countless experiments and testing.

In view of that, this invention has been put forward to overcome the disadvantages aforesaid.

SUMMARY OF THE INVENTION

With a view of the above-mentioned disadvantages, it is an object of the present invention to provide a washing method to obtain best washing conditions by make use of electrolyzed water, and users of washing machine may add a drastically reduced amount of a detergent (or other auxiliary agents), or even without addition of any detergent.

It is a further object of the present invention to provide an auxiliary device of washing machine, which is simple in structure and convenient for installation without altering the internal structure of current washing machine by hanging and mounting the auxiliary device on the housing, so that the existing washing machine will be retrofitted or otherwise utilized to be a washing machine which has no need of adding detergent by the users.

It is yet another object of this invention to provide a washing machine equipped with a new washing auxiliary device simple in structure and convenient for installation, and the users do not need to add detergent during washing.

The inventors of the present invention found that the influence of hardness of washing liquid on detergency is mainly due to its influence on the chemical structure of detergent, and the reaction between detergent molecules and contaminant molecules. However, under the washing conditions of the present invention, this influence hardly exists, so we infer that the hardness of water will not have any practical negative effect on detergency. Although inventors of the present invention think water hardness has no dominating influence on detergency ratio under the washing conditions of the present invention, the testing results showed that under the washing conditions of this invention, it is preferable to keep the hardness of washing liquid in a range from 5 to 400 ppm, which could be achieved by the electrolyzing process and addition of modifying agent. In accordance with the first aspect of the present invention, there is provided a washing method comprising electrolyzing tap water, or adding a certain dosage of modifying agent at the same time, The PH of electrolyzed water is maintained in the range from 8.5 to 11. The electric conductivity of washing water after electrolysis, including modifying agent possibly added, is from 261 us/cm to 875 us/cm, while the surface tension is from 25 to 40 mN/m. The washing water used in the process of this invention is electrolyzed water or the mixture of electrolyzed water and modifying agent added. Water temperature of washing is in the range from 5° C. to 50° C., preferably from 10° C. to 30° C.

The PH is preferable from 9.0 to 11, or more preferably 9.8.

The detergency ratio of the washing process is in a range from 0.1 to 0.5 tested according to GB4288.

In case the pH of washing liquid is lower than 8.5, a proper dosage of washing powder shall be put into the electrolyzed water, yet the dosage of washing powder shall not be larger than 0.2% on the basis of the washing water.

As the analysis on current technology indicates, washing conditions are really complicated, so the change of a single factor barely meets the requirements in modern washing. No matter it is a selective invention, or an innovative invention, the most important contribution of this invention consists in controlling a lot of different factors within a certain scope, and enabling the comprehensive index of the washing liquid within this scope to stay at a standard level from the beginning of washing to the end. The tap water supplied into the electrolyzing cell is electrolyzed to get acidic ionized water and alkaline ionized water respectively. The latter is supplied into the washing tub, where the water temperature and PH reach the predetermined values, and the alkaline ionized water comes to the predetermined water level, it is activated by the modifying agent fed by the modifying agent supply device, and then, normal washing course is performed.

The washing method comprises the steps of: tap water is supplied to the electrolyzing cell to be electrolyzed, acidic ionized water and alkaline ionized water are generated respectively, and alkaline water is supplied into the washing tub, acidic ionized water is stored up, then the alkaline ionized water which is activated by the modifying agent fed by the modifying agent supply device reaches the washing water level, normal washing course starts; the rinsing operation is performed after water is supplied into the washing tub again, or a proper amount of acidic ionized water is introduced for rinsing the laundry, and some tap water is introduced to meet the predetermined water level to fulfill the entire washing process.

The washing process comprises the steps of: tap water is supplied to the electrolyzing cell to be electrolyzed, acidic ionized water and alkaline ionized water are generated respectively, and alkaline water is supplied into the washing tub, acidic ionized water is discharged; then, modifying agent is added to the alkaline ionized water from modifying agent feeding device, and it will be activated accordingly. As the alkaline ionized water activated by the modifying agent fed by the modifying agent supply device reaches the predetermined water level, normal washing process starts. The rinsing operation is performed after water is supplied into the washing tub again, electrolytic polarity of the electrolyzing cell is changed to produce acidic ionized water and alkaline ionized water respectively, acidic ionized water is fed into the washing tub, alkaline ionized water is discharged, and some tap water is introduced to meet the predetermined water level to fulfill the entire rinsing operation.

The washing process comprises the steps of: tap water is supplied to the electrolyzing cell to be electrolyzed, acidic ionized water and alkaline ionized water are generated respectively, and alkaline water is supplied into the washing tub, acidic ionized water is discharged; then, the alkaline ionized water shall be added with modifying agent through modifying agent feeding device, and it will be activated accordingly. Then the alkaline ionized water activated by the modifying agent fed by the modifying agent supply device reaches the predetermined water level, normal washing process starts; the rinsing operation is performed after water is supplied into the washing tub again, electrolytic polarity of the electrolyzing cell is changed to produce acidic ionized water and alkaline ionized water respectively, acidic ionized water is fed into the washing tub to the predetermined water level to fulfill the entire rinsing operation, while alkaline ionized water is discharged.

To realize the above process, the present invention provides a washing machine comprising a housing, a washing tub for containing laundry, an outer tub for containing washing tub, a water supply device for supplying water into washing tub, an electrolyzed water generating device for providing electrolyzed water, a water level detecting means for detecting a level of water supplied into the washing tub, and a modifying agent feeding device for providing modifying agent into the washing tub. The modifying agent feeding device is connected with the water supply device, and the electrolyzed water generating device which connected with the water supply device provides electrolyzed water with pH at least 8.5; and the modifying agent feeding device feeds modifying agent into the washing tub as required quantify by the user.

In one embodiment of the present invention, the water supply device comprises: a water supply tube which is connected with tap water tube, a water supply valve, a water supply port which is provided on the upper part of washing tub, a first water supply path connecting with the water supply valve and a water supply port, and a second tap water supply tube connecting to the output end of water supply valve. The electrolytic water generating device and modifying agent feeding device is placed at the output end of the second tap water supply tube. The electrolytic water generating device comprises: a electrolyzing cell with diaphragms, a power supply converting device for converting alternating current into direct current (DC) to provide DC to the electrolyzing cell. The water inlet of the electrolyzing cell is connected to the second tap water supply tube of the output end of water supply valve. Cathode chamber and Anode chamber of the electrolyzing cell are connected to the first drainpipe for providing electrolytic solution to the washing tub, and the second drainpipe connecting to the water drainage tube respectively. The modifying agent feeding device comprises: at least a liquid storage container, a Dosing & Feeding device set at the lower part of the liquid storage container for providing modifying agent at a certain quantity. One input end of the Dosing & Feeding device is connected with the liquid outlet tube at the bottom of the liquid storage container, while one output end of the Dosing & Feeding device is linked to the first drainpipe, the other output end is connected with water drainage tube and the second drainpipe through emptying pipe.

Alternatively, in another embodiment of the present invention, the water supply device comprises: water supply tube which is connected with tap water tube, water supply valve, a water supply port which is provided on the upper part of washing tub, a first water supply path connecting with the water supply valve and the water supply port, a second tap water supply tube connecting to the output end of water supply valve, and a third tap water supply tube connecting with the output end of water supply valve. The electrolytic water-generating device is set at the output end of the second tap water supply tube, and modifying agent feeding device is connected with the output end of the third tap water supply tube. The electrolytic water generating device comprises: a electrolyzing cell with diaphragm, a power supply converting device for converting alternating current into direct current (DC) to provide DC to the electrolyzing cell. The water inlet of the electrolyzing cell is connected to the second tap water supply tube of the output end of water supply valve. Cathode chamber and Anode chamber of the electrolyzing cell are connected to the first drainpipe for providing electrolytic solution to the washing tub and, and the second drainpipe connecting to the water drainage tube respectively. The modifying agent feeding device comprises: at least a liquid storage container, a Dosing & Feeding device at the lower part of liquid storage container for supplying the modifying agent with rations. One input end of the Dosing & Feeding device is connected with the liquid outlet tube at the bottom of the liquid storage container, and the other input end of the Dosing & Feeding device is connected with the third tap water supply tube of the water supply valve, while one output end of the Dosing & Feeding device is connected with water supply port which is provided on the upper part of washing tub, the other output end is connected with water drainage tube and the second drainpipe through emptying pipe.

The Dosing & Feeding device is volumetric measuring valve, electromagnetic valve or electric valve.

When the measuring valve employs the volumetric measuring valve, it comprises: a buffer chamber with a rating volume at the center of the valve, a liquid inlet of buffer chamber for adding additives, a water inlet valve set in the opposite of liquid inlet, and a water outlet, the measuring valve is connected to the part of electrolyzed water path through the above mentioned water outlet and the water inlet. A water inlet and a liquid inlet valve are employed in water inlet and liquid inlet for alternatively control the water inlet and water outlet for their turn-on and turn-off. A liquid outlet is set at the output of the buffer chamber, and an emptying valve is assigned at the bottom of the buffer chamber.

The existing washing machine is utilized without any changes in structure, a first perforation is configured at the upper part of the rear panel of housing of a washing machine for passing through the water supply tube of electrolyzed water, and the second perforation is configured at the lower part of that of a washing machine for passing through the second drainpipe connecting to the water drainage tube.

The electrolyzing cell of electrolyzed water generating device, and/or the liquid storage container of the modifying agent feeding device is hanged externally and mounted on the housing of washing machine. In a broader sense, it is acceptable to hang the electrolyzing cell and/or the liquid storage container externally and fixed up around the washing machine (i.e. on the front panel, at the left/right side, and the rear panel); however, considering the appearance of the washing machine, hanging externally on the front panel, at the left or the right side of washing machine will impose a negative effect on the visual image of the washing machine on a whole. What's more, since the impeller in washing machine always rotates clockwise or counter clockwise, so, when the impeller starts to rotate or ends rotating, its initial point or the ending point usually lies at the front or back of washing machine, and the high-speed rotating point often at the left or right side. It is well known that the rotation of washing machine starts with one acceleration, ending with another, therefore, only at the initial and the ending points will the rotary force has a minimum value. In other words, as the impeller is rotating, the front panel and the rear panel have a slighter impact from rotary force, comparing with the impact the left and right side endure resulting from rotary force. It is especially true when the housing is equipped with an electrolyzing cell and/or a liquid storage container, which has/have a certain weight. For the electrolyzing cell and/or liquid storage container themselves (itself) undergo(es) a downward gravity, if they (it) are (is) placed at the left or right side withstanding stronger impact by the rotary force, due to the impeller rotation, they (it) may affect the smooth rotation of impeller, fray the impeller axle, or sway the machine body. In this case, it is preferable to hang the electrolyzing cell and/or the liquid storage container externally and fix them (it) upon the lateral surface of the housing back of washing machine.

The simplest fix-up method is often applied, namely, first, pegging the electrolyzing cell and/or liquid storage container on the lateral surface of the housing back of washing machine with bolts. Next, hooding a cover board onto the lateral surface of the above cell or container.

It is suggested that the hanged thickness of the electrolyzing cell or liquid storage container shall be less than ¼ of that of washing machine, preferably 1/10. Width and height of the electrolyzing cell or liquid storage container shall be less than that of the washing machine.

The washing machine discussed here can be selected from the double-driven, impeller, agitator, or drum washing machine.

The advantages of the present invention consist in the following aspects:

This invention adjust the PH value of washing liquid to between 9 and 11, by virtue of modifying the electrolyzed tap water, and then conducts testing under different accessional procedures to master a number of experimental data. The method depicted in this invention helps to realize a washing without detergent, and makes it possible to reduce expenses and avoids environmental pollution brought about by the use of detergent otherwise. Meanwhile, the modification of washing water eradicates the situation of fabric hardening, and creates the most delightful washing conditions. The structure in this invention is simple, and the operations like assembly, maintenance, disassembly, are quite easy to cope with, too. Hanging externally and fixed up the electrolyzing cell of electrolyzed water generating device, plus the liquid storage chamber on the housing back of washing machine, means that this invention reserves the intrinsic structure of the existing washing machine, and in this precondition, the invention increases some functions, such as employing electrolyzed water in washing, adding modifying agent, etc. It is the innovations and modification that make this invention have intensifying adaptability and lead to cost reduction.

EMBODIMENTS OF THE INVENTION

Figure 1:
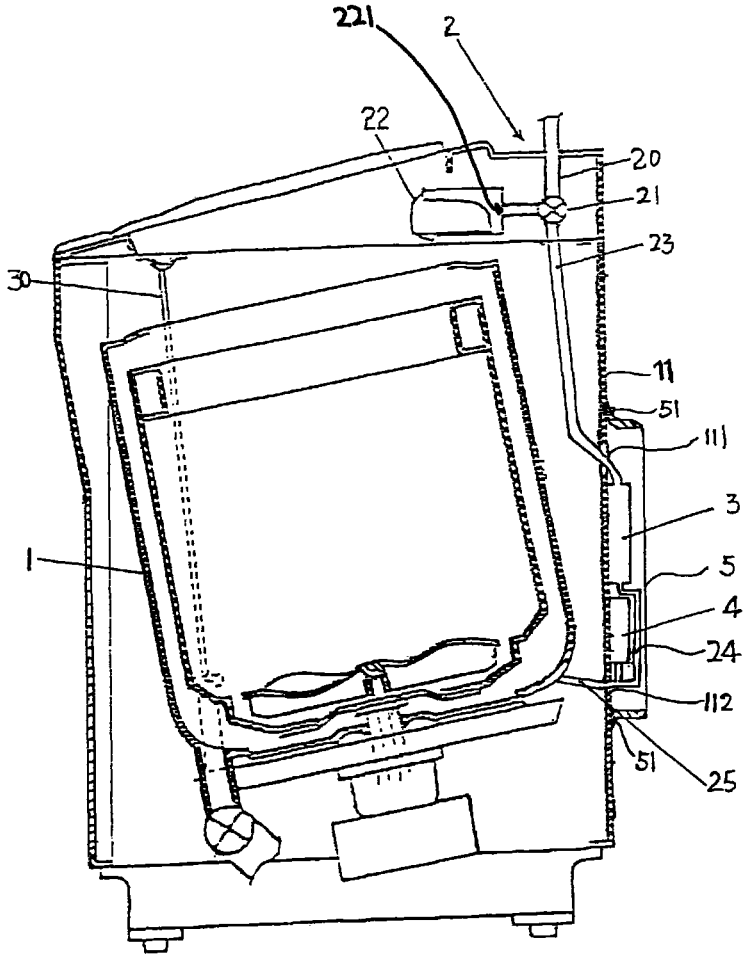
FIG. 1 is a side sectional view of a fully automatic washing machine according to one embodiment of the present invention.
Figure 2:
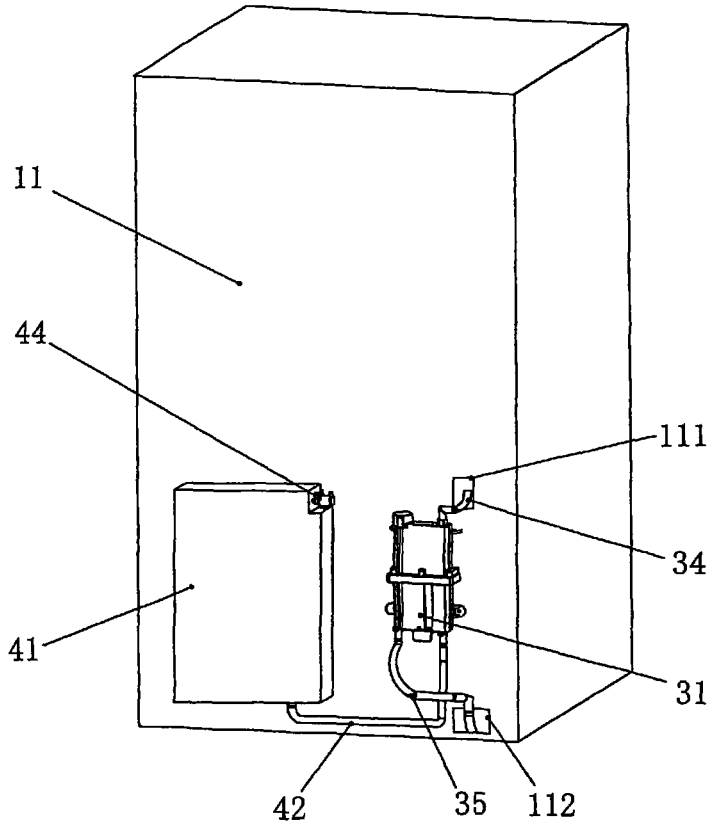
FIG. 2 is a schematic structural view of the housing back of the washing machine shown in FIG. 1 after uncovering cover board.
Figure 3:
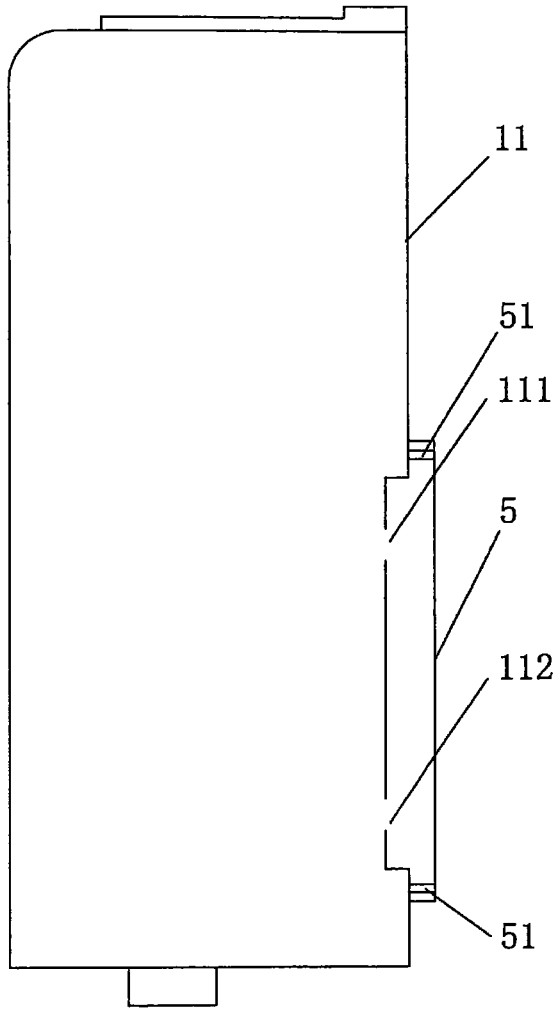
FIG. 3 is a side view of FIG. 1.
Figure 4:
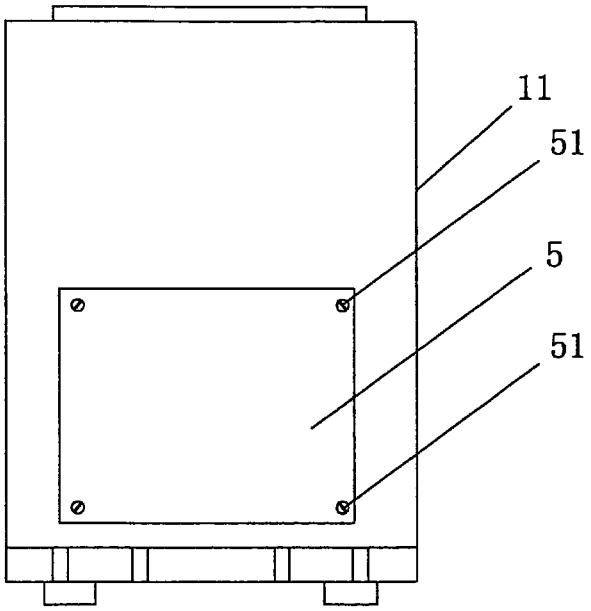
FIG. 4 is a rear view of FIG. 1.

The embodiments of the present invention will hereinafter be described with reference to the attached drawings.

A washing machine without addition of a detergent by users as shown in FIG. 1 to FIG. 4, comprises a housing 11, an outer tub 1 for containing the washing tub, a water supply device 2 for supplying water to washing tub, and an water electrolytic water generating device 3 (electrolysis means) for providing electrolyzed water. The water electrolytic water generating device 3 for providing electrolyzed water with PH at least 8.5 to washing tub is connected in series with the water supply device 2; a modifying agent feeding device 4 for providing modifying agent to the washing tub is connected with the water supply device 2, and feeds modifying agent to the washing tub as required quantify by the user during washing process.

Figure 5:
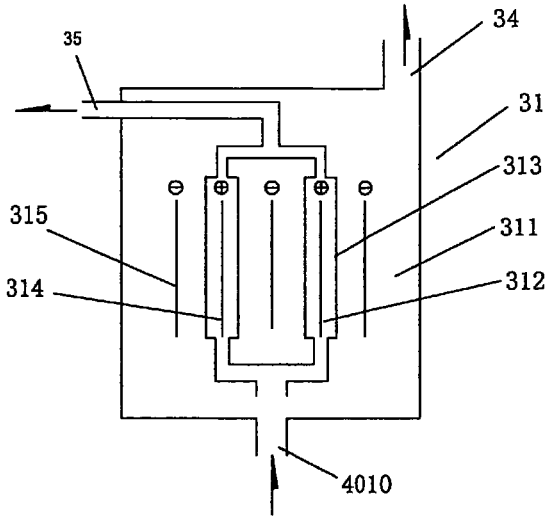
FIG. 5 is a schematic structural view of an embodiment of an electrolyzing cell of the present invention.
Figure 6:
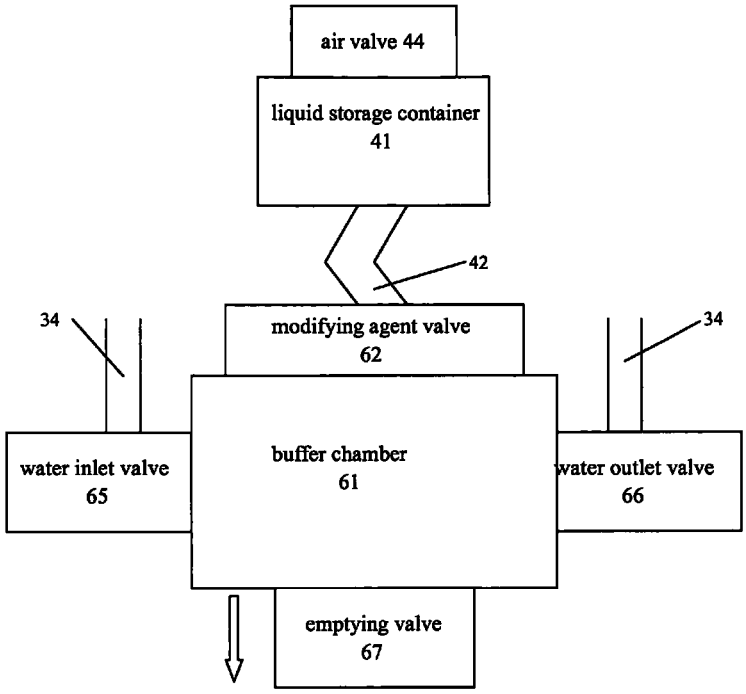
FIG. 6 is a schematic structural view of an embodiment of a Dosing & Feeding device of a modifying agent-feeding device of the present invention

In one embodiment of the present invention as shown in FIG. 1 to 6, the water supply device 2 comprises: water supply tube 20 which is connected with tap water tube, water supply valve 21, a water supply port 22 which is provided on the upper part of washing tub, the first water supply path 221 connecting with the water supply valve 21 and the water supply port 22, and the second tap water supply tube 23 connecting to the output end of water supply valve 21. The electrolytic water generating device 3 and modifying agent feeding device 4 is placed at the output end of the second tap water supply tube 23. The water supply valve 21 is provided on the upper part of outer tub 1 and is designed in the type of three-way value, namely, one inlet and three outlets. The water supply port 22 on the upper part of washing tub is connected with the water supply path 221 between the water supply valve 21 and the water supply port 22. The electrolytic water generating device 3 comprises: a electrolyzing cell 31 with diaphragm, a power supply converting device for converting alternating current into direct current (DC) to provide DC to the electrolyzing cell (not shown in the drawings). The water inlet 4010 of the electrolyzing cell is connected to the second tap water supply tube of the output end of water supply valve 21. Cathode chamber and Anode chamber of the electrolyzing cell are connected to the first drainpipe 34 for providing electrolytic solution to the washing tub, and the second drainpipe 35 connecting to the water drainage tube respectively. The modifying agent feeding device 4 comprises: at least a liquid storage container 41, the liquid outlet tube 42 at the bottom of liquid storage container 41 is connected to the first drainpipe 34 via the Dosing & Feeding device set at the lower part of the liquid storage container for providing modifying agent at fixed quantity (not shown in the drawings). An air valve or air admission valve 44 is located on the top of liquid storage container 41. (The above-mentioned Dosing & Feeding device could be a metering valve, or a volumetric measuring valve as shown in FIG. 6). One input end of the Dosing & Feeding device is connected with the liquid outlet tube 42 at the bottom of the liquid storage container, while one output end of the Dosing & Feeding device is linked to the first drainpipe 34, the other output end is connected with water drainage tube and the second drainpipe 35 through emptying pipe.

As shown in FIG. 6, the metering valve 6 employs the volumetric measuring type, which comprises: a buffer chamber 61 with a rating volume at the center of valve, a modifying agent valve 62 for adding additives, a water inlet valve 65, a water outlet valve 66 and a emptying valve 67. The modifying agent valve 62 is actually a liquid inlet, while the water inlet valve 65 is virtually a water inlet, and water outlet valve 66 is a water outlet, so that valve 6 is connected to the part of electrolyzed water path through above mentioned outlet and the water inlet. The water inlet valve 65 and water outlet valve 66 alternatively control the water inlet and water outlet for their turn-on and turn-off; while the water outlet valve 66 functions not only to let water flow out, but also to discharge the modifying agent out of the buffer chamber 61. In addition, an emptying valve 67 is assigned at the bottom of the buffer chamber.

FIG. 5 shows an embodiment of electrolyzing cell with diaphragm, which comprises five cathode chambers 311 and four anode chambers 312, and all the chambers are arranged separately from each other by the eight ion-penetrated diaphragms 313; alternatively, the electrolyzing cell may also comprises seven cathode chambers 311 and six anode chambers 312, whereas the chambers are arranged separately from each other by the twelve ion-penetrated diaphragms 313. The ratio of cross-sectional area of flow passage for cathode chamber 311 against anode chamber 312 of the said electrolytic chamber is from 10:1 to 2:1, preferably, the ratio value is between 6:1 and 3:1.

In another embodiment of the present invention (not shown in the drawings) the water supply device comprises: water supply tube which is connected with tap water tube, water supply valve, a water supply port which is provided on the upper part of washing tub, a first water supply path connecting with the water supply valve and the water supply port, a second tap water supply tube connecting to the output end of water supply valve, and a third tap water supply tube connecting with the output end of water supply valve. The electrolytic water-generating device is set at the output end of the second tap water supply tube, and modifying agent feeding device is connected with the output end of the s third tap water supply tube. The electrolytic water generating device comprises: a electrolyzing cell with diaphragm, a power supply converting device for converting alternating current into direct current (DC) to provide DC to the electrolyzing cell. The water inlet of the electrolyzing cell is connected to the second tap water supply tube of the output end of water supply valve. Cathode chamber and Anode chamber of the electrolyzing cell are connected to the first drainpipe for providing electrolytic solution to the washing tub and, and the second drainpipe connecting to the water drainage tube respectively. The modifying agent feeding device comprises: at least a liquid storage container, a Dosing & Feeding device at the lower part of liquid storage container for supplying the modifying agent with rations. One input end of the Dosing & Feeding device is connected with the liquid outlet tube at the bottom of the liquid storage container, and the other input end of the Dosing & Feeding device is connected with the third tap water supply tube of the water supply valve, while one output end of the Dosing & Feeding device is connected with water supply port which is provided on the upper part of washing tub, the other output end is connected with water drainage tube and the second drainpipe through emptying pipe.

FIG. 5 is a schematic diagram schematically illustrating the construction of the electrolyzing cell with diaphragm. It shows the structure of electrolyzing cell 31. The electrolyzing cell 31 has three cathode chambers 311 and two anode chambers 312 comparted by diaphragm 313, in which anode pole 314 and cathode pole 315 are provided respectively. The ratio of cross sectional area of cathode chamber 311 to anode chamber 312 of electrolyzing cell in the present invention is 4:1. The cathode chambers 311 and anode chambers 312 of the electrolyzing cell 31 is connected with the first drainpipe 34 for supplying electrolytic solution to the washing tub and the second drainpipe 35 connecting to the water drainage respectively.

Further more, fin radiator (not shown in the drawing) is built inside the power supply converter to improve the efficiency of thermal dissipation. A cooling water jacket is provided joining the fin radiator (not shown in the drawing). Electrolyzing cell 31 is connected with the cooling water jacket. The water inlet tube of the electrolyzing cell 31 is connected with that cooling water jacket so that the tap water is electrolyzed in the electrolyzing cell 31 after passing through the cooling water jacket of the power supply converter 32.

Electrolyzed water left in the electrolyzing cell will be forced into the washing tub by the pressure of the tap water.

It is preferred in the present invention that electrolyzing cell 31 of the electrolytic water generating device 3 and/or of liquid storage container 41 of modifying agent feeding device is disposed on the outer surface of the rear panel of housing, the rest components of the two devices can be still put between the housing and the outer tub of the washing machine. More specifically, two perforations 111 and 112 are formed on the rear panel of housing, the second tap water supply tube 23 is connected with electrolyzing cell 31 and liquid storage container 41 through upper perforations 111, and electrolyzed water supply tube 24 is connected with water inlet pipe 25 of washing tub through lower perforation 112 (Referring to side or rear drawing of FIG. 1 or 2). As for washing machines employing only the electrolytic water-generating device, electrolyzing cell can be hung on rear panel of housing. To consider comprehensively the size and weight of the device fitted on the panel; the thickness of the electrolyzing cell or liquid storage container shall be less than ¼ of that of washing machine, preferably 1/10. Width and height of the electrolyzing cell or liquid storage container shall be less than that of the washing machine.

The electrolyzing cell 31 and/or liquid storage container 41 which are mount on the outer surface of the rear panel of housing of the washing machine is covered with a cover plate 5, which is fixed to the housing as a whole with bolt 51.

An electrolytic water generating device 3 and/or modifying agent feeding device electrolyzed water generator and modifying agent supplying device are set on the washing machine, a three-way valve is provided at water-supply tube of the washing machine, water drainage valve and solution drainage valve will be set at the outlet of water drainage and solution drainage respectively, of all those characters had been disclosed in details in the series patent applications filed on November 2003 by the applicant of this invention, for example: application number: 200320121902.8, entitle: Additive Supply Device; application number: 200320121903.2, entitle: Electrolyzed water Feeding Loop; application number: 200320121901.3, entitle: Washing Machine with Electrolytic Device; application number: 200310113629.9, entitle: Washing Machine and Washing Method, et al. All these reference are introduced in as background and prior art for technical details and will not be described in this invention. During operation, water supply valve 21 is connected with the tap water tube. The three outlets of water supply valve are directly connected to the water supply path of washing tub, water inlet of the softener box and electrolyzed water inlet of electrolytic water generating device. The control programs are stored in the board computer for current washing course or washing program with electrolyzed water instead of washing powder. If the user chooses a washing course without the use of washing powder, electrolytic water generating device starts to work. Tap water flux is controlled from 1.0 to 10 L/min by water supply valve 21, preferably from 3.5 to 6.0 L/min to ensure the efficiency of electrolytic process. Tap water is introduced into electrolyzing cell 31 to be electrolyzed therein. Alkaline water and acid water will be produced by the cathode and anode, and is comparted by the diaphragm. Then alkaline water is introduced into the inner tub through to the first drainpipe 34 to wash clothes, at the same time the acid water will flow out through the second drainpipe 35 to sterilize the laundry. Because the ratio of cross-sectional area of flow passage for cathode chamber 311 against anode chamber 312 of the said electrolytic chamber is 4:1, the flux of alkaline water is large than that of acid water. That is, output flux ratio of alkaline water to acid water is controlled to be from 3:1 to 6:1 to reduce consumption of waste water, ensure electrolytic efficiency and achieve the proper PH of 9.8±1.2.

When the electrolytic water generating device works conversely, acid water is produced and flowed from the cathode chamber. Because of the predetermined ratio of cross sectional area of cathode chamber 311 to anode chamber 312, the flow of alkaline water from the second drainpipe 35 to the washing tub is less than that of acid water from the first drainpipe 34, thus it is suitable for rinsing operation due to the function of sterilization and disinfection.

Some washing machines or washing methods with no need of adding detergent, or even washing the laundry by using electrolyzed water directly, has been disclosed in the prior art including patent publication.

But what has been brought forward in the prior art is only a concept of improving the PH of water through electrolysis. Water with high PH has higher detergency ratio in clothes washing, which is also known in the prior art. However, as to what is the proper PH, by which a reasonable electrolysis cost and washing time may be obtained, and the washing operation does not damage to clothing materials, have not been disclosed in the prior art. In particularly, what is the standard referring to the so-called no need of detergent? It does not mean anything without a comparison standard. In fact, washing with only tape water can achieve certain detergency ratio without specifically limitation of comparison condition; especially when the dirt is mainly ash, the detergency ratio may high.

So, a comparison standard is introduced at first, that is, all national standard washing machine is utilized as part of test standard in the present invention. More specifically, the test method of washing performance is introduced and described in detail based on the above-mentioned standard. All the parameters to testify the nonobviousness of the present invention are obtained on the basis of this standard.

This invention mainly makes comprehensive test on the washing effect (detergency ratio, PH, electrical conductivity, surface tension etc) achieved with different water quality (with or without washing powder) under conditions of defined water temperature, volume and the same washing process to obtain an washing method under optimum washing condition.

Test procedure and test condition of this invention are shown in Table 1 and Table 2, referring details in Table 1 and Table 2.

TABLE 1

Measurements under water temperature of 10° C. and capacity of 100%:

| S/N | Water Quality | Washing Powder | Detergency ratio (Range) | PH | Surface Tension mN/m | Electrical Conductivity us/cm |
|---|---|---|---|---|---|---|
| 11 | Electrolysis + modifying agent | None | 0.245-0.285 | 10.573-10.574 | 32 | 261-262 |
| 12 | Electrolyzed water | None | 0.1422-0.1786 | 10.406-10.807 | 66 | 246-963 |
| 13 | Electrolyzed water | 0.2% | 0.2318-0.3218 | 10.656 | 30 | 283 |
| 14 | Tap water | None | 0.0786-0.1375 | 7.473 | 69 | 222 |
| 15 | Tap water | 0.2% | 0.2462-0.3144 | 9.9 | 30 | 222 |

The other conditions for the comparative test in Table 1 above include:

(1) Load of 5.2 Kg;

(2) Standard course is applied as the washing procedure;

(3) The experimental data shown is a range obtained from several tests under actual water temperature in the range of 9.2° C.-15.1° C.;

(4) Double-driven washing machine is taken as the test model. (For the double driven washing machine refers to CN02110035, CN02110368 etc., and other references related to double driven washing machine disclosed by applicant of this invention is introduced as the background.)

It can be seen from the experiment data in the above Table, under the same temperature, the same volume capacity and with the same washing procedure, the detergency ratio will be 0.265, average PH will be 10.57, average surface tension will be 32 mN/m and average electrical conductivity will be 261.5 us/cm if electrolyzed water with water-environment improvement (hereinafter referred to as active electrolyzed water) is employed for washing; the average detergency ratio will be 0.16, average PH will be 10.6, average surface tension will be 66 mN/m and average electrical conductivity will be 604.5 us/cm if only electrolyzed water is employed; the average detergency ratio will be 0.2768, average PH will be 10.656, surface tension will be 30 mN/m and average electrical conductivity will be 283 us/cm if electrolyzed water is employed in combination with addition of 0.2% washing powder; the average detergency ratio will be 0.108, average PH will be 7.473, average surface tension will be 69 mN/m and average electrical conductivity will be 222 us/cm if tap water is employed; the average detergency ratio will be 0.2803, average PH will be 7.473, average surface tension will be 30 mN/m and average electrical conductivity will be 222 us/cm if tap water is combined with 0.2% washing powder.

From the data above, it can be concluded that: comparing washing method by employing only electrolyzed water, or tap water added with washing powder with that by employing active electrolyzed water, or only electrolyzed water added with washing powder, the optimum washing condition without washing powder is that the average detergency ratio is 0.265, average PH is 10.57, average surface tension is 32 mN/m and the average electrical conductivity is in the range from 261 to 262 us/cm.

TABLE 2

Experimental data under water temperature of 30° C. and capacity of 80%:

| S/N | Water Quality | Washing Powder | Detergency ratio (Range) | PH Value | Surface Tension mN/m | Electrical Conductivity us/cm |
|---|---|---|---|---|---|---|
| 21 | Active electrolyzed water | None | 0.2978-0.3546 | 10.11-10.273 | 31 | 279-872 |
| 22 | Electrolyzed water | 0.2% | 0.36 | 10.158 | 30 | 318 |
| 23 | Tap water | None | 0.1795-0.2103 | 7.511-7.584 | 70 | 201-205 |
| 24 | Tap water | 0.2% | 0.2866-0.3644 | 7.495-7.914 | 30 | 206-222 |

The other conditions for the comparative test in Table 2 above include:

(1) Load of 5.0 Kg;

(2) Standard course is applied as the washing procedure;

(3) The experimental data shown is a range obtained from several tests under actual water temperature in the range of 30° C.-32° C.;

(4) Double-driven washing machine is taken as the test model.

It can be seen from the experiment data in the Table above that, under the same temperature, the same volume capacity and with the same washing procedure, the average detergency ratio will be 0.326, average PH will be 10.19, average surface tension will be 31 mN/m and average electrical conductivity will be 575.5 us/cm if Active electrolyzed water is employed for washing; the average cleaning rate will be 0.36, average PH will be 10.158, average surface tension will be 67 mN/m and average electrical conductivity will be 318 us/cm if electrolyzed water added with 0.2% washing powder is employed; the detergency ratio rate will be 0.1949, average PH will be 7.547, average surface tension will be 70 mN/m and average electrical conductivity will be 203 us/cm if tap water is employed; the average detergency ratio will be 0.326, average PH will be 7.708, and average electrical conductivity will be 214 us/cm if tap water added with 0.2% washing powder is employed.

Comparing washing method by employing electrolyzed water or that added with washing powder with the method by employing tap water or that added with washing powder, the optimum washing condition obtained without washing powder is that the average detergency ratio is 0.326, average PH is 10.19, average surface tension is about 31 mN/m, however, the average electrical conductivity is relatively high.

From the data above, it can be seen that washing performance can be improved by adding washing powder into the electrolyzed water. PH when employing electrolyzed water is closer to the standard value of washing machine than that when employing tap water, moreover, the surface tension of the electrolyzed water is much lower tap water, hence better washing effect is obtained.

In comprehensive consideration of the two Tables above, it can be concluded that, without considering capacity and whether washing powder is added, water temperature of 30° C. is more preferable than 10° C. under the same washing condition, and will thus achieve optimum washing result.

EXAMPLE 1

The water temperature is predetermined at 10° C. and capacity of 100%, washing operation is performed by employing active electrolyzed water under standard course: During the process of washing: under actual water temperature of 9.2° C., the tap water flows into the electrolyzing cell, from which alkaline ionized water and acidic ionized water with steady PH are produced, the former will be used to regulate water quality by adding modifying agent and then enter into the washing tub after being activated, while the latter will be drained. PH in the tub at this moment reaches 10.57, which is the best value for washing, meanwhile, normal washing will begin when the alkaline ionized water inflow reaches the predetermined water level and terminate after conducting the standard course for fifteen minutes at least. The surface tension is 31 mN/m, electrical conductivity is 261 us/cm and detergency ratio is 0.2258. The activated alkaline ionized water with steady PH performs the same function as the washing powder; therefore, detergent is unnecessary for this method.

EXAMPLE 2

The water temperature is predetermined at 10° C. and capacity of 60%, washing operation is performed by employing electrolyzed water under standard course:

Group 1, During washing under water temperature of 11.5° C., tap water is firstly electrolyzed in the electrolyzing cell in which alkaline ionized water and acidic ionized water with steady PH will be generated, the alkaline ionized water flows into the washing tub while the acidic ionized water will be stored. By adding certain dose of modifying agent, PH in the tub will be 10.405 that suitable for washing. After the alkaline ionized water is introduced to the set water level, washing is carried out for eight minutes, it is measured that the surface tension is 34 mN/m, electrical conductivity is 486 us/cm and detergency ratio is 0.2015. It can be concluded from the experiment data in this group that: the electrical conductivity is relatively high. Furthermore, rinse can be performed along with water inflow for the second time, when the stored acidic ionized water together with some tap water may be introduced into the washing tub to the predetermined level. In this embodiment, the water in the tub for rinsing is the acidic ionized water with certain concentration; laundry can be cleaned and sterilized while being rinsed.

Group 2, During washing under water temperature of 9.7° C., tap water will be firstly electrolyzed in the electrolyzing cell in which alkaline ionized water and acidic ionized water with steady PH will be produced, the alkaline ionized water is introduced into the washing tub while the acidic ionized water will be stored. By adding certain quantity of modifying agent, PH in the tub will be 10.625 that suitable for washing. When the water level in the washing tub reaches a predetermined level, washing is carried out for twenty-five minutes, rinsing is performed for two times and the total washing period lasts for fifty-seven minutes. It can be eventually measured that the surface tension of washing water is 32 mN/m, electrical conductivity is 273 us/cm and detergency ratio is 0.255.

It can be concluded from the experiment data in Group 1 and Group 2 that: washing efficiency will be improved along with the increase of washing duration when water temperature is decreased.

Group 3, during washing under water temperature of 12.2° C., tap water will be firstly electrolyzed in the electrolyzing cell in which alkaline ionized water and acidic ionized water with steady PH will be produced, the alkaline ionized water is introduced into the washing tub while the acidic ionized water will be stored. PH in the tub will be 10.468 after certain quantity of modifying agent is added. When the water level in the washing tub reaches a predetermined level, washing procedure for "jeans" with water level 10 and in standard course is chosen for washing a period of twenty-five minutes. The total washing period lasts for fifty-seven minutes. It can be measured that the surface tension of washing water is 30 mN/m, electrical conductivity is 246 us/cm and detergency ratio is 0.2586.

Group 4. Water temperature is 12.2° C. during washing operation. Tap water will be firstly electrolyzed in the electrolyzing cell in which alkaline ionized water and acidic ionized water with steady PH will be produced, the alkaline ionized water is introduced into the washing tub while the acidic ionized water will be stored. PH in the tub is 10.468 after certain quantity of modifying agent is added to soften the water. When the water level in the washing tub reaches a predetermined level, washing procedure for "jeans" with water level 10 and in standard course is chosen for washing a period of twenty-five minutes, the first rinsing operation is performed by acidic ionized water. The total washing period lasts for fifty-seven minutes. It can be measured that the surface tension of washing water is 30 mN/m, electrical conductivity is 273 us/cm and detergency ratio is 0.27.

It can be concluded from the experiment data in Group 3 and Group 4 that: along with increase of washing duration and enhancement of washing water inflow when water temperature is decreased, washing efficiency with acid water rinsing operation is better than that of simple washing procedure.

EXAMPLE 3

Washing is performed at the water temperature of 30° C. and capacity of 60% by employing electrolyzed water and with standard course.

Group 5, during washing under water temperature of 39.0° C., tap water will be firstly electrolyzed in the electrolyzing cell in which alkaline ionized water and acidic ionized water with steady PH will be produced, the alkaline ionized water is introduced into the washing tub while the acidic ionized water will be stored. PH in the tub will be 10.103 after the addition of certain quantity of modifying agent. When the water level in the washing tub reaches a predetermined level, washing is performed with washing water level 6 and rinsing water level 10 and in standard course for twenty-five minutes, and the total washing period lasts for fifty-seven minutes. It can be measured that the surface tension of washing water is 30 mN/m, electrical conductivity is 57 us/cm and detergency ratio is 0.3631.

Group 6, Water temperature is 37.9° C. during washing operation. Tap water will be firstly electrolyzed in the electrolyzing cell in which alkaline ionized water and acidic ionized water with steady PH will be produced, the alkaline ionized water is introduced into the washing tub while the acidic ionized water will be stored. PH in the tub is 10.468 after a certain quantity of modifying agent is added to soften the water. When the water level in the washing tub reaches a predetermined level, washing is performed at standard course. It can be measured that the surface tension of washing water is 33 mN/m, electrical conductivity is 463 us/cm and detergency ratio is 0.3402.

It is shown from the experiment in Group 5 and Group 6 that: under water temperature of above 30° C., the higher the temperature, the higher the PH, the higher the detergency ratio will be.

Modifying agent or modifying liquor in this invention refers to the liquid that is able to increase the surface activity and help to regulate the washing liquid to the defined washing condition described above, including factors such as surface tension, hardness, electrical conductivity etc, when washing, and it is not decomposed under acidic condition. The modifying agent can be the mixture of one or more detergents, such as alkyl poly glycoside (APG) (Non ionic surfactant as well as a kind of environment-friendly surfactant).

Besides as a favorable auxiliary detergent agent, the surfactant disclosed in CN 02141004 and the surfactant of citric acid trialkyl acidamide disclosed in CN 01123249 are also the modifying agent for electrical conductivity and surface tension, which can be introduced into this invention as the means to constitute the final washing condition. Actually, many surfactants available in prior art that are suitable for regulating the washing liquid to the washing condition parameters as required by this invention. These surfactants can be introduced as the entire or a part of modifying agent of this invention, and person skill in the art in this field can attain ways whether the modifying agent is applied individually or mixed, and the composition proportion in case of mixed application. After comprehending the details of this invention.

In this invention, the modifying agent shall be added with 0.2-3.0 g each time.

We claim:

1. A washing machine for washing laundry without addition of a detergent by the user comprising:

a housing;

a washing tub for containing laundry;

an outer tub for containing the washing tub;

a water supply device for supplying water into the washing tub;

an electrolyzed water-generating device connected with the water supply device for providing electrolyzed water; and a modifying agent feeding device for providing a modifying agent into the washing tub, wherein the modifying agent feeding device is connected with the water supply device, wherein the electrolyzed water-generating device provides electrolyzed water with a pH of at least 8.5, wherein the washing machine maintains the washing water pH in the range from 8.5 to 11, wherein the washing water electric conductivity is from 261 μS/cm to 875 μS/cm, and wherein the washing water has a surface tension from 25 to 40 mN/m during washing operation, the modifying agent is a mixture of one or more detergent, wherein the water supply device comprises:

a water supply tube for connection with a tap water source;

a water supply valve;

a water supply port provided on the upper part of washing tub;

a first water supply path connecting the water supply valve and the water supply port; and a second tap water supply tube connected to an output end of the water supply valve, wherein the electrolyzed water-generating device and the modifying agent feeding device are positioned at the output end of the second tap water supply tube, and wherein the electrolytic water generating device comprises:

an electrolyzing cell having a plurality of diaphragms, a water inlet, a cathode chamber and an anode chamber;

a power supply converting device for converting alternating current into direct current (DC) to provide DC current to the electrolyzing cell; wherein the water inlet of the electrolyzing cell is connected to the second tap water supply tube of the output end of the water supply valve, wherein the cathode chamber and the anode chamber of the electrolyzing cell are connected to a first drainpipe for providing electrolytic solution to the washing tub, and a second drainpipe connected to a water drainage tube, respectively, and wherein the modifying agent feeding device comprises:

a liquid storage container having a bottom;

a dosing and feeding device having an input end and a plurality of output ends, set at a lower part of the liquid storage container for providing modifying agent at a certain quantity, wherein the input end of the dosing and feeding device is connected with a liquid outlet tube at the bottom of the liquid storage container, wherein the dosing and feeding device is a volumetric measuring valve comprising:

a buffer chamber with a rating volume being arranged on the center of the volumetric measuring valve, a modifying agent valve located at the liquid outlet tube at a bottom of the liquid storage container for introducing a modifying agent into the buffer chamber, a water inlet valve and a water outlet valve set in the opposite of the buffer chamber, an emptying valve at the bottom of the buffer chamber, wherein the water inlet valve is connected to the first drainpipe which is connected with the cathode chamber of the electrolytic generating device for providing alkaline ionized water into the buffer chamber, the water outlet valve is connected to the first drainpipe and discharging the mixture of electrolytic solution and modifying agent from the buffer chamber into the washing tub; and the water inlet valve and water outlet valve alternatively control the water flow into and out the buffer chamber by their turn-on and turn-off, and the electrolyzing cell of the electrolyzed water generating device, and the liquid storage container of the modifying agent feeding device are externally hung and mounted on the housing.

2. The washing machine of claim 1, wherein a hardness of the washing water is in range from 5 to 400 ppm and the amount of the modifying agent is added within 0.2 to 3.0 g each washing time.

3. The washing machine of claim 1, wherein the electrolyzing cell and the liquid storage container of the modifying agent feeding device are externally hung and mounted upon the lateral surface of the housing back of the washing machine.

4. The washing machine of claim 1, wherein a first perforation is provided at an upper part of a rear panel of the housing, for allowing a tap water supply tube to pass through the first perforation and connected with the electrolyzing cell, and wherein a second perforation is provided at a lower part of the rear panel of the housing for passing the first drainpipe which is connected with a water inlet pipe of the washing tub for discharging the mixture of electrolytic solution and modifying agent into the washing tub.

5. A washing machine for washing laundry without addition of a detergent by the user comprising:

a housing;

a washing tub for containing laundry;

an electrolyzed water generating device having an electrolyzing cell with a cathode chamber and an anode chamber for providing electrolyzed water; the cathode chamber is connected to a first drainpipe for providing alkaline ionized water to the washing tub; and, a modifying agent feeding device having a liquid storage container, for providing a modifying agent into the washing tub, wherein the electrolyzing cell of the electrolyzed water generating device, and/or the liquid storage container of the modifying agent feeding device is externally hung and mounted on the housing, the modifying agent is a mixture of one or more detergent, wherein the modifying agent feeding device comprises:

a liquid storage container having a bottom;

a dosing and feeding device having an input end and a plurality of output ends, set at a lower part of the liquid storage container for providing modifying agent at a certain quantity, wherein the input end of the dosing and feeding device is connected with a liquid outlet tube at the bottom of the liquid storage container, wherein one output end of the dosing and feeding device is linked to the first drainpipe connecting to the cathode chamber of the electrolyzing cell, and another output end is connected with a water drainage tube and a second drainpipe through an emptying pipe, wherein the dosing and feeding device is a volumetric measuring valve comprising:

a buffer chamber with a rating volume being arranged on the center of the volumetric measuring valve, a modifying agent valve located at the liquid outlet tube at the bottom of the liquid storage container for introducing a modifying agent into the buffer chamber, a water inlet valve and a water outlet valve set in the opposite of the buffer chamber, an emptying valve at the bottom of the buffer chamber, wherein the water inlet valve is connected to the first drainpipe which is connected with the cathode chamber of the electrolytic generating device, and the water inlet valve and water outlet valve alternatively control the water flow into and out the buffer chamber by their turn-on and turn-off; the water outlet valve is connected to the first drainpipe and discharging the mixture of alkaline water and modifying agent from the buffer chamber into the washing tub; and the amount of the modifying agent is added within 0.2 to 3.0 g each washing time.

6. The washing machine of claim 5, wherein the electrolyzing cell and/or the liquid storage container are/is externally hung and mounted upon the lateral surface of a housing back of the washing machine.

7. The washing machine of claim 5, wherein a first perforation is provided at an upper part of a rear panel of the housing, for allowing a tap water supply tube to pass through the first perforation and connected with the electrolyzing cell, and wherein a second perforation is provided at a lower part of the rear panel of the housing for passing the first drainpipe which is connected with a water inlet pipe of the washing tub for discharging the mixture of electrolytic solution and modifying agent into the washing tub.

8. The washing machine of claim 1, wherein the electrolyzing cell and/or the liquid storage container is covered with a covering board.

9. A method of washing laundry in a washing machine without addition of a detergent by the user, comprising the steps of:

electrolyzing tap water and simultaneously adding a dosage of modifying agent, a washing water being a mixture solution of alkaline ionized water and the modifying agent, wherein a pH of the washing water is maintained in the range from 8.5 to 11, wherein the electric conductivity of the washing water is from 261 μS/cm to 875 μS/cm, the modifying agent is a mixture of one or more detergent, wherein steps of said method comprises:

supplying tap water to an electrolyzing cell for electrolyzing of the tap water to generate an acidic ionized water and an alkaline ionized water respectively;

supplying the alkaline water into a washing tub and storing the acidic ionized water for sterilizing items;

wherein the alkaline ionized water is activated by the modifying agent fed by a modifying agent feeding device mounted on a housing of washing machine;

starting a normal washing; and, performing a rinsing operation after water is supplied into the washing tub again, or a proper amount of acidic ionized water is introduced for rinsing the items; and supplying tap water to meet a predetermined water level, wherein the modifying agent is fed by the modifying agent feeding device which comprises:

a liquid storage container having a bottom;

a dosing and feeding device having an input end and a plurality of output ends, set at a lower part of the liquid storage container for providing modifying agent at a certain quantity, wherein the input end of the dosing and feeding device is connected with a liquid outlet tube at a bottom of the liquid storage container, wherein the dosing and feeding device is a volumetric measuring valve comprising:

a buffer chamber with a rating volume being arranged on the center of the volumetric measuring valve, a modifying agent valve located at the liquid outlet tube at the bottom of the liquid storage container for introducing modifying agent into the buffer chamber, a water inlet valve and a water outlet valve set in the opposite of the buffer chamber, an emptying valve at the bottom of the buffer chamber, wherein the water inlet valve and the water outlet valve is connected respectively to a first drainpipe which connected to a cathode chamber of the electrolyzing cell for providing electrolytic solution into the buffer chamber, the water outlet valve is connected to the first drainpipe and discharging the mixture of electrolytic solution and modifying agent from the buffer chamber into the washing tub, and the water inlet valve and water outlet valve alternatively control the water feeding into the buffer chamber and discharging the mixture of electrolytic solution and modifying agent from the buffer chamber into the washing tub by their turn-on and turn-off.

10. The method of claim 9, wherein the pH of the washing water is maintained in the range from 9 to 11.

* * * * *